US011261746B2

(12) United States Patent
Kanzaki

(10) Patent No.: US 11,261,746 B2
(45) Date of Patent: Mar. 1, 2022

(54) TURBINE AND TURBOCHARGER

(71) Applicant: IHI Corporation, Tokyo (JP)

(72) Inventor: Dai Kanzaki, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 17/108,134

(22) Filed: Dec. 1, 2020

(65) Prior Publication Data

US 2021/0102471 A1 Apr. 8, 2021

Related U.S. Application Data

(63) Continuation of application No. PCT/JP2019/011496, filed on Mar. 19, 2019.

(30) Foreign Application Priority Data

Jun. 29, 2018 (JP) ..... JP2018-123842

(51) Int. Cl.
*F01D 9/02* (2006.01)
*F01D 25/24* (2006.01)

(52) U.S. Cl.
CPC ..... *F01D 9/026* (2013.01); *F01D 25/24* (2013.01); *F05D 2220/40* (2013.01); *F05D 2240/12* (2013.01); *F05D 2260/60* (2013.01)

(58) Field of Classification Search
CPC ..... F01D 9/026; F01D 25/24; F02B 39/00; F05D 2220/40; F05D 2240/12; F05D 2260/60
See application file for complete search history.

(56) References Cited

U.S. PATENT DOCUMENTS 7,931,437 B1 * 4/2011 Johnson ..... F01D 9/026 415/184
9,587,554 B2 * 3/2017 Hoshi ..... F02B 37/025
(Continued)

FOREIGN PATENT DOCUMENTS

CN 102220883 A 10/2011
CN 104854325 A 8/2015
(Continued)

OTHER PUBLICATIONS

International Search Report dated May 14, 2019 in PCT/JP2019/011496 filed on Mar. 19, 2019 (with English Translation), therein, 2 pages.
(Continued)

*Primary Examiner* — Igor Kershteyn
(74) *Attorney, Agent, or Firm* — Oblon, McClelland, Maier & Neustadt, L.L.P.

(57) ABSTRACT

Provided is a turbine, including: a housing having a discharge port; a turbine rotor, which is arranged in the housing, and includes: a hub provided on a shaft; blades provided on an outer periphery of the hub; and an inclined portion, which is formed at an outer peripheral end of each of the blades, and is inclined toward a leading side in a rotation direction as approaching the discharge port side; a turbine scroll flow passage formed in the housing; and a tongue portion including: a distal end portion protruding into the turbine scroll flow passage; and a tapered surface, which is formed in the
(Continued)

distal end portion, and is inclined toward the leading side in the rotation direction of the shaft as approaching the discharge port side.

9 Claims, 3 Drawing Sheets

(56) References Cited

U.S. PATENT DOCUMENTS

2003/0077170 A1* 4/2003 Osako ..... F01D 9/026 415/204
2011/0008162 A1* 1/2011 Yokoyama ..... F01D 9/026 415/204
2011/0232282 A1* 9/2011 Anschel ..... F02B 37/025 60/615
2013/0219885 A1* 8/2013 Watson ..... F01D 17/148 60/605.1
2013/0266433 A1* 10/2013 Yokoyama ..... F01D 9/026 415/205
2013/0287560 A1 10/2013 Osako et al.
2014/0294577 A1* 10/2014 Yoshida ..... F04D 29/403 415/204
2015/0023788 A1* 1/2015 Shoghi ..... F01D 25/24 415/208.1
2016/0003196 A1* 1/2016 Hang ..... F02B 37/025 60/605.2
2017/0022830 A1* 1/2017 Hughes ..... F01D 25/24
2017/0114668 A1 4/2017 Franz et al.
2017/0292381 A1 10/2017 Ishii

FOREIGN PATENT DOCUMENTS

CN 104937234 A 9/2015
CN 105275593 A 1/2016
CN 105408638 A 3/2016
CN 106795807 A 5/2017
CN 106907195 A 6/2017
JP 62-111942 U 7/1987
JP 04-035542 Y2 8/1992
JP 2004-092481 A 3/2004
JP 2012-132321 A 7/2012
WO WO 2010/047259 A1 4/2010
WO WO 201 6/035329 A1 3/2016

OTHER PUBLICATIONS

Chinese Office Action issued in Chinese Patent Application No. 201980037741.8 dated Nov. 16, 2021.

* cited by examiner

TURBINE AND TURBOCHARGER

CROSS REFERENCE TO RELATED APPLICATIONS

This application is a continuation application of International Application No. PCT/JP2019/011496, filed on Mar. 19, 2019, which claims priority to Japanese Patent Application No. 2018-123842, filed on Jun. 29, 2018, the entire contents of which are incorporated by reference herein.

BACKGROUND ART

Technical Field

The present disclosure relates to a turbine and to a turbocharger.

Related Art

A turbine is provided in a turbocharger. A turbine scroll flow passage is formed on a radially outer side of a turbine rotor of the turbine. For example, as described in Patent Literature 1, an upstream portion and a downstream portion of the turbine scroll flow passage are partitioned by a tongue portion. The tongue portion is radially opposed to the turbine rotor.

CITATION LIST

Patent Literature

Patent Literature 1: JP 2012-132321 A

SUMMARY

Technical Problem

When exhaust gas leaks from the upstream portion to the downstream portion of the turbine scroll flow passage through a gap between the tongue portion and the turbine rotor, a turbine performance is degraded. Therefore, there has been a demand for development of a technology of suppressing the leakage amount of the exhaust gas, to thereby improve the turbine performance.

The present disclosure has an object to provide a turbine and a turbocharger capable of improving a turbine performance.

Solution to Problem

In order to achieve the above-mentioned object, according to one embodiment of the present disclosure, there is provided a turbine, including: a housing having a discharge port; a turbine rotor, which is arranged in the housing, and includes: a hub provided on a shaft; blades provided on an outer periphery of the hub; and an inclined portion, which is formed at an outer peripheral end of each of the blades, and is inclined toward a leading side in a rotation direction as approaching the discharge port side; a turbine scroll flow passage formed in the housing; and a tongue portion including: a distal end portion protruding into the turbine scroll flow passage; and a tapered surface, which is formed in the distal end portion, and is inclined toward the leading side in the rotation direction of the shaft as approaching the discharge port side.

The tapered surface may be formed in a surface of the distal end portion on the leading side in the rotation direction.

The tapered surface may be formed in a surface of the distal end portion on a trailing side in the rotation direction.

The turbine scroll flow passage may include a plurality of turbine scroll flow passage portions, and the number of tongue portions may be the same as the number of turbine scroll flow passage portions.

In order to achieve the above-mentioned object, according to one embodiment of the present disclosure, there is provided a turbocharger, including the turbine described above.

Effects of Disclosure

According to the present disclosure, it is possible to improve a turbine performance.

DESCRIPTION OF EMBODIMENT

Figure 1:
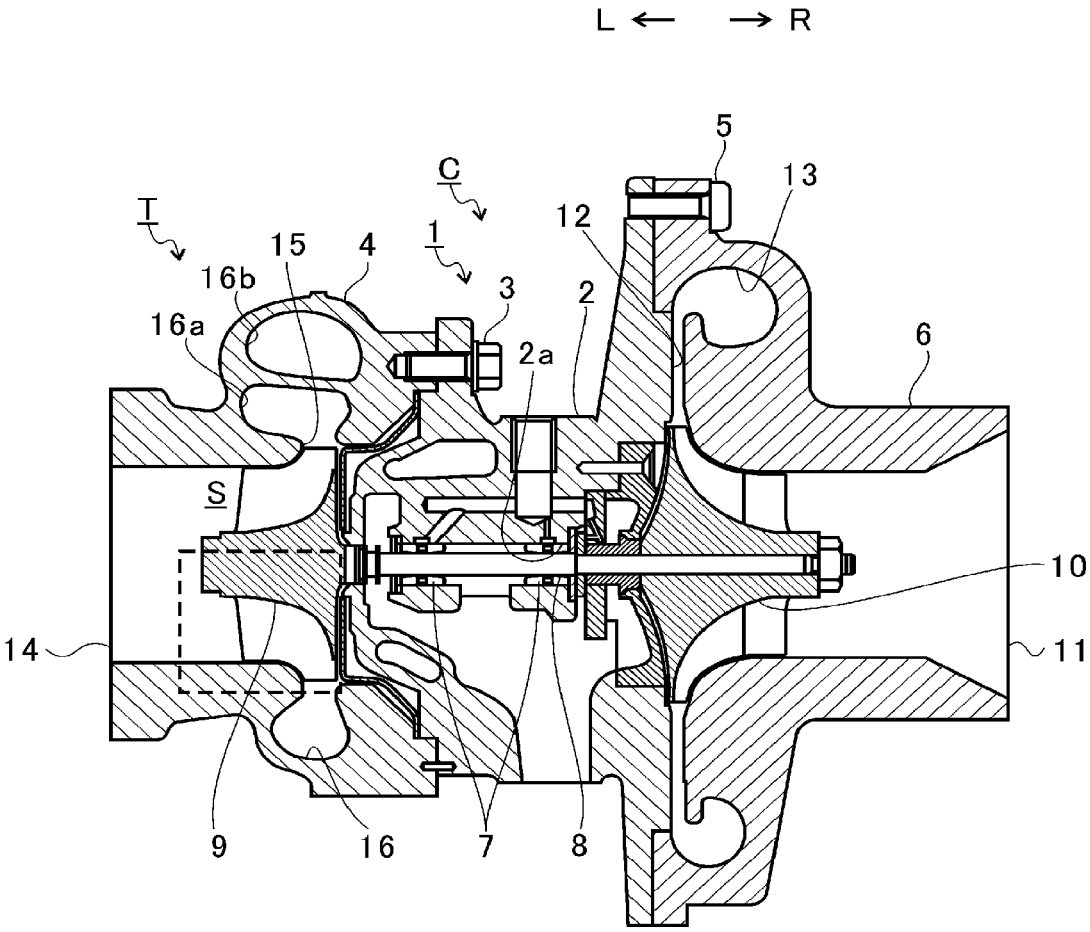
FIG. 1 is a schematic sectional view of a turbocharger.

Now, with reference to the attached drawings, one embodiment of the present disclosure is described in detail. The dimensions, materials, and other specific numerical values represented in the embodiment are merely examples used for facilitating the understanding of the invention, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is a schematic sectional view of a turbocharger C. The direction indicated by the arrow L illustrated in FIG. 1 corresponds to a left side of the turbocharger C. The direction indicated by the arrow R illustrated in FIG. 1 corresponds to a right side of the turbocharger C. As illustrated in FIG. 1, the turbocharger C includes a turbocharger main body 1. The turbocharger main body 1 includes a bearing housing 2. A turbine housing 4 (housing) is coupled to the bearing housing 2 on the left side by a fastening bolt 3. A compressor housing 6 is coupled to the bearing housing 2 on the right side by a fastening bolt 5.

The bearing housing 2 has a bearing hole 2*a*. The bearing hole 2*a* passes through the bearing housing 2 in a right-and-left direction of the turbocharger C. A bearing 7 is provided in the bearing hole 2*a*. In FIG. 1, a full-floating bearing is illustrated as an example of the bearing 7. However, the bearing 7 may be other radial bearing such as a semi-floating bearing or a rolling bearing. A shaft 8 is axially supported by the bearing 7 so as to be rotatable. A turbine rotor 9 (turbine impeller) is provided at a left end portion of the shaft 8. The turbine rotor 9 is received in an accommodation space S, which is formed in the turbine housing 4, so as to be rotatable. Moreover, a compressor impeller 10 is provided at a right end portion of the shaft 8. The compressor impeller 10 is received in the compressor housing 6 so as to be rotatable.

The compressor housing 6 has a suction port 11. The suction port 11 is opened on the right side of the turbocharger C. The suction port 11 is connected to an air cleaner (not shown). Further, under a state in which the bearing housing 2 and the compressor housing 6 are coupled to each other by the fastening bolt 5, a diffuser flow passage 12 is formed. The diffuser flow passage 12 increases pressure of air. The diffuser flow passage 12 is annularly formed so as to extend from an inner side toward an outer side in a radial direction of the shaft 8. The diffuser flow passage 12 communicates with the suction port 11 through intermediation of the compressor impeller 10 on the inner side in the radial direction of the shaft 8.

The compressor housing 6 has a compressor scroll flow passage 13. The compressor scroll flow passage 13 has an annular shape. The compressor scroll flow passage 13 is, for example, located on a radially outer side of the shaft 8 with respect to the diffuser flow passage 12. The compressor scroll flow passage 13 communicates with a suction port of an engine (not shown). The compressor scroll flow passage 13 communicates also with the diffuser flow passage 12. When the compressor impeller 10 is rotated, air is sucked into the compressor housing 6 through the suction port 11. The sucked air is increased in speed by an action of a centrifugal force during a course of flowing through blades of the compressor impeller 10. The air increased in speed is increased in pressure in the diffuser flow passage 12 and the compressor scroll flow passage 13. The air increased in pressure is introduced to the suction port of the engine.

The turbine housing 4 has a discharge port 14. The discharge port 14 is opened on the left side of the turbocharger C. The discharge port 14 is connected to an exhaust gas purification device (not shown). The discharge port 14 communicates with the accommodation space S. Further, a flow passage 15 and a turbine scroll flow passage 16 are formed in the turbine housing 4. The turbine scroll flow passage 16 is located more on an outer side in a radial direction of the turbine rotor 9 than the accommodation space S. The flow passage 15 is located between the accommodation space S and the turbine scroll flow passage 16. The flow passage 15 allows the accommodation space S and the turbine scroll flow passage 16 to communicate with each other.

The turbine scroll flow passage 16 includes two turbine scroll flow passage portions 16*a* and 16*b*. A detailed description is given of respective shapes of the turbine scroll flow passage portions 16*a* and 16*b* later.

Figure 2:
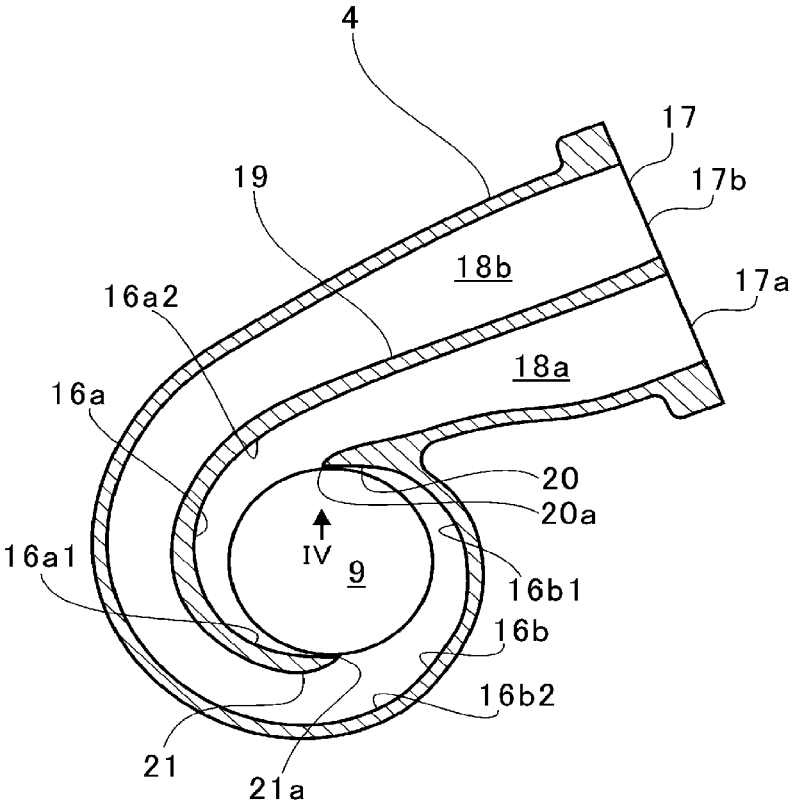
FIG. 2 is a sectional view of a turbine housing.

The turbine scroll flow passage 16 communicates with a gas inflow port 17 (see FIG. 2). Exhaust gas discharged from an exhaust manifold of an engine (not shown) is led to the gas inflow port 17. The turbine scroll flow passage 16 communicates also with the flow passage 15. The exhaust gas led from the gas inflow port 17 to the turbine scroll flow passage 16 is led to the discharge port 14 through the flow passage 15 and gaps between blades of the turbine rotor 9. The exhaust gas led to the discharge port 14 rotates the turbine rotor 9 in the course of flowing.

As described above, the turbocharger C includes a turbine T. The turbine T includes the turbine housing 4, the turbine rotor 9, and the turbine scroll flow passage 16. A rotational force of the turbine rotor 9 is transmitted to the compressor impeller 10 through the shaft 8. As described above, the air is increased in pressure by the rotational force of the compressor impeller 10, and is then led to the suction port of the engine.

FIG. 2 is a sectional view of the turbine housing 4. FIG. 2 is a view of the housing 4 taken along a plane that is perpendicular to an axial direction of the shaft 8, and passes through the flow passage 15. Moreover, in FIG. 2, only an outer periphery of the turbine rotor 9 is indicated by a circle.

As illustrated in FIG. 2, the gas inflow port 17 is formed in the turbine housing 4. The gas inflow port 17 includes two gas inflow port portions 17*a* and 17*b*. The gas inflow port portions 17*a* and 17*b* are open to the outside of the turbine housing 4.

An introduction passage 18*a* extending in a substantially linear manner is formed between the gas inflow port portion 17*a* and the turbine scroll flow passage portion 16*a*. The gas inflow port portion 17*a* communicates with the turbine scroll flow passage portion 16*a* through the introduction passage 18*a*. Similarly, an introduction passage 18*b* extending in a substantially linear manner is formed between the gas inflow port portion 17*b* and the turbine scroll flow passage portion 16*b*. The gas inflow port portion 17*b* communicates with the turbine scroll flow passage portion 16*b* through the introduction passage 18*b*.

The turbine scroll flow passage portion 16*a*, the gas inflow port portion 17*a*, and the introduction passage 18*a* are partitioned from the turbine scroll flow passage portion 16*b*, the gas inflow port portion 17*b*, and the introduction passage 18*b* by a partition wall 19.

The turbine scroll flow passage portion 16*a* is located more on the inner side in the radial direction of the shaft 8 than the turbine scroll flow passage portion 16*b*. The turbine scroll flow passage portion 16*a* extends along an approximately half circumference on the radially outer side of the turbine rotor 9. The turbine scroll flow passage portion 16*a* is radially opposed to the turbine rotor 9 along the approximately half circumference. The turbine scroll flow passage portion 16*a* decreases in width in the radial direction as separating away from the gas inflow port portion 17*a*.

The turbine scroll flow passage portion 16*b* extends along a substantially whole circumference on the radially outer side of the turbine rotor 9. The turbine scroll flow passage portion 16*a* is interposed between the turbine rotor 9 and a portion of the turbine scroll flow passage portion 16*b* corresponding to an approximately half circumference of the turbine rotor 9. The turbine scroll flow passage portion 16*b* is radially opposed to the turbine rotor 9 along an approximately half circumference, which is a remaining portion without the interposition of the turbine scroll flow passage portion 16*a*. The turbine scroll flow passage portion 16*b* decreases in width in the radial direction as separating away from the gas inflow port portion 17*b*.

An upstream portion 16*a*2 of the turbine scroll flow passage portion 16*a* is located more on an upstream side in a flow direction of the exhaust gas than a downstream portion 16*a*1. The upstream portion 16*a*2 is closer to the gas inflow port portion 17*a* than the downstream portion 16*a*1. The upstream portion 16*a*2 is larger in width in the radial direction of the shaft 8 than the downstream portion 16*a*1. Similarly, an upstream portion 16*b*2 of the turbine scroll flow passage portion 16*b* is located more on the upstream side in the flow direction of the exhaust gas than a downstream portion 16*b*1. The upstream portion 16*b*2 is closer to the gas inflow port portion 17*b* than the downstream portion 16*b*1. The upstream portion 16*b*2 is larger in width in the radial direction of the shaft 8 than the downstream portion 16*b*1.

Moreover, two tongue portions 20 and 21 are formed in the turbine housing 4. A distal end portion 20*a* of the tongue portion 20 protrudes into the turbine scroll flow passage 16. The downstream portion 16*b*1 of the turbine scroll flow passage portion 16*b* and the upstream portion 16*a*2 of the turbine scroll flow passage portion 16*a* are partitioned by the tongue portion 20. Similarly, a distal end portion 21*a* of the tongue portion 21 protrudes into the turbine scroll flow passage 16. The downstream portion 16*a*1 of the turbine scroll flow passage portion 16*a* and the upstream portion 16*b*2 of the turbine scroll flow passage portion 16*b* are partitioned by the tongue portion 21. The tongue portions 20 and 21 are radially opposed to the turbine rotor 9.

As described above, the turbine T of the turbocharger C includes the two turbine scroll flow passage portions 16*a* and 16*b*, and is thus of a so-called double scroll flow passage type.

Figure 3:
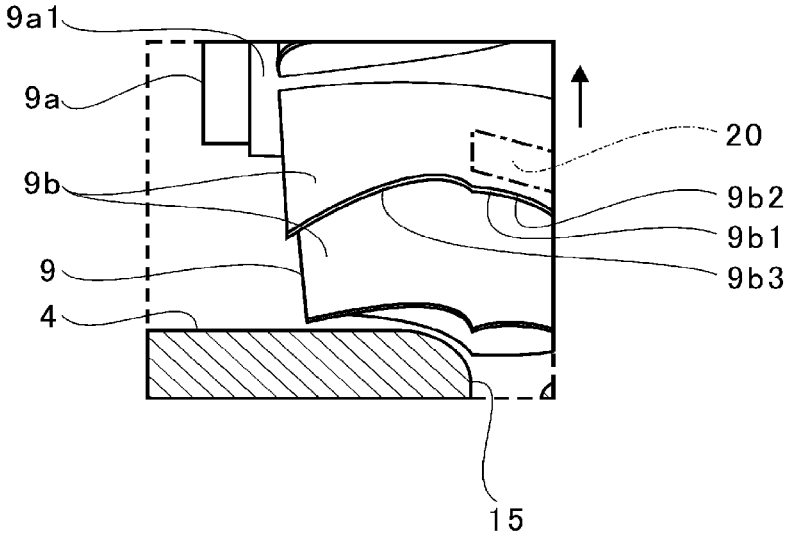
FIG. 3 is an extracted view of a portion indicated by a broken line of FIG. 1.

FIG. 3 is an extracted view of a portion indicated by a broken line of FIG. 1. FIG. 3 is a side view for illustrating the turbine rotor 9. Moreover, in FIG. 3, the tongue portion 20 located on the radially outer side of the turbine rotor 9 is projected on the turbine rotor 9 on the radially inner side and is indicated by a one-dot chain line. In FIG. 3, a rotation direction of the shaft 8 (that is, a rotation direction of the turbine rotor 9, hereinafter simply referred to as a rotation direction) is indicated by an arrow.

As illustrated in FIG. 3, the turbine rotor 9 includes a hub 9*a* and blades 9*b*. The hub 9*a* is provided on the shaft 8. The blades 9*b* are provided on an outer peripheral surface 9*a*1 of the hub 9*a*. A plurality of blades 9*b* are formed apart in a circumferential direction of the hub 9*a*.

An inclined portion 9*b*2 (leading edge) is formed at an outer peripheral end 9*b*1 of the blade 9*b* (end surface of the blade 9*b* on a side opposite to a base end), which is an end portion on the radially outer side of the hub 9*a*. The inclined portion 9*b*2 is inclined toward a leading side in the rotation direction as approaching the discharge port 14 side (in FIG. 3, a left side, a distal end side of the hub 9*a*, or a side away from the shaft 8 in an axial direction). The inclined portion 9*b*2 is radially opposed to the flow passage 15.

Moreover, a reversely inclined portion 9*b*3 is formed at the outer peripheral end 9*b*1 of the blade 9*b* on the discharge port 14 side with respect to the inclined portion 9*b*2. The reversely inclined portion 9*b*3 is inclined opposite to the inclined portion 9*b*2. That is, the reversely inclined portion 9*b*3 is inclined toward a trailing side in the rotation direction as approaching the discharge port 14 side.

As described above, the blade 9*b* has a shape of expanding in a vicinity of a center toward the leading side in the rotation direction as a result of the formation of the inclined portion 9*b*2 and the reversely inclined portion 9*b*3. Therefore, when the blades 9*b* receive the flow of the exhaust gas, energy of the exhaust gas is efficiently converted to a rotational force of the shaft 8.

Figure 4:
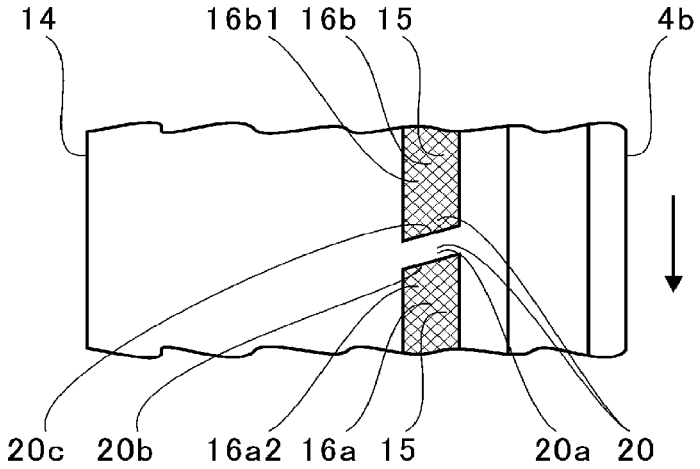
FIG. 4 is a sectional view of the turbine housing as seen in a direction indicated by an IV arrow of FIG. 2.

FIG. 4 is a sectional view of turbine housing 4 as seen in a direction indicated by an IV arrow of FIG. 2. That is, FIG. 4 is a view of the turbine housing 4 as seen from the radially inner side of the shaft 8. In FIG. 4, a part of the turbine housing 4 in the circumferential direction of the shaft 8 is extracted and illustrated. In FIG. 4, the left side is the discharge port 14 side, and the right side is a side of an abutment surface 4*b* against the bearing housing 2. In FIG. 4, the flow passage 15 (see FIG. 1) is indicated by a crosshatching.

Two tapered surfaces 20*b* and 20*c* are formed in the distal end portion 20*a* of the tongue portion 20. The tapered surface 20*b* is formed in a surface of the distal end portion 20*a* on the leading side (lower side of FIG. 4) in the rotation direction. The tapered surface 20*c* is formed in a surface of the distal end portion 20*a* on the trailing side (upper side of FIG. 4) in the rotation direction.

The tapered surfaces 20*b* and 20*c* are inclined toward the leading side (lower side of FIG. 4) in the rotation direction as approaching the discharge port 14 side (the left side of FIG. 4 or a side away from the bearing housing 2). That is, the tapered surfaces 20*b* and 20*c* are inclined in the same direction as the inclined portion 9*b*2 of each of the blades 9*b* of the turbine rotor 9. Moreover, the inclination of the tapered surface 20*b* is parallel with the inclination of the tapered surface 20*c*. However, the inclination of the tapered surface 20*b* is not required to be parallel with the inclination of the tapered surface 20*c*.

When the turbine rotor 9 rotates, the distal end portion 20*a* of the tongue portion 20 is radially opposed to the inclined portion 9*b*2 of the blade 9*b* depending on a rotation angle (phase) of the turbine rotor 9. In this state, it is assumed that the exhaust gas passes through a gap between the distal end portion 20*a* of the tongue portion 20 and the inclined portion 9*b*2 of the blade 9*b*. In this case, the exhaust gas leaks from the upstream portion 16*a*2 of the turbine scroll flow passage portion 16*a* to the downstream portion 16*b*1 of the turbine scroll flow passage portion 16*b*, and a turbine performance thus decreases.

As described above, the tapered surfaces 20*b* and 20*c* inclined at the same angle as the inclined portion 9*b*2 of each of the blades 9*b* are formed in the distal end portion 20*a* of the tongue portion 20. Therefore, the following action is provided when the distal end portion 20*a* of the tongue portion 20 is radially opposed to the inclined portion 9*b*2 of the blade 9*b*. That is, a flow passage width of the communication portion between the upstream portion 16*a*2 of the turbine scroll flow passage portion 16*a* and the downstream portion 16*b*1 of the turbine scroll flow passage portion 16*b* is suppressed to be narrow. As a result, the leakage amount of the exhaust gas from the upstream portion 16*a*2 of the turbine scroll flow passage portion 16*a* to the downstream portion 16*b*1 of the turbine scroll flow passage portion 16*b* is suppressed. Thus, the turbine performance is improved.

Moreover, the inclinations of the tapered surfaces 20*b* and 20*c* are parallel with the inclination of the inclined portion 9*b*2 of each of the blades 9*b*. Therefore, the leakage amount of the exhaust gas from the upstream portion 16*a*2 of the turbine scroll flow passage portion 16*a* to the downstream portion 16*b*1 of the turbine scroll flow passage portion 16*b* is more likely to be suppressed. However, the inclinations of the tapered surfaces 20*b* and 20*c* are not required to be parallel with the inclination of the inclined portion 9*b*2 of each of the blades 9*b* (may be different in inclination angle).

Figure 5:
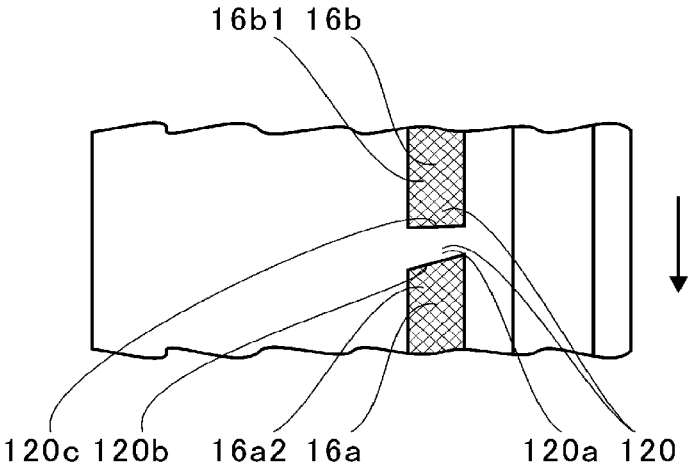
FIG. 5 is an explanatory view for illustrating a modification example.

FIG. 5 is an explanatory view for illustrating a modification example. In FIG. 5, portions in the modification example corresponding to portions of FIG. 4 are illustrated. As illustrated in FIG. 5, a tapered surface 120*b* similar to the tapered surface 20*b* in the embodiment described above is formed in a distal end portion 120*a* of a tongue portion 120 in the modification example. However, the tapered surface 20*c* is not formed in the distal end portion 120*a*. That is, a surface of the distal end portion 120*a* on the trailing side (lower side of FIG. 5) in the rotation direction is a parallel surface 120*c* in parallel with the axial direction of the shaft 8.

As described above, even when only the tapered surface 120*b* is formed in the distal end portion 120*a*, the leakage amount of the exhaust gas from the upstream portion 16*a*2 of the turbine scroll flow passage portion 16*a* to the downstream portion 16*b*1 of the turbine scroll flow passage portion 16*b* is suppressed. Thus, the turbine performance is improved.

In the modification example, description has been given of the case in which the tapered surface 120*b* is formed on the leading side of the distal end portion 120*a* in the rotation direction, and the parallel surface 120*c* is formed on the trailing side in the rotation direction. Conversely, a tapered surface may be formed on the trailing side of the distal end portion 120*a* in the rotation direction, and a parallel surface may be formed on the leading side in the rotation direction. However, the following effect is provided when the tapered surface 120*b* is formed on only the leading side of the distal end portion 120*a* in the rotation direction as in the modification example. That is, the inflow of the exhaust gas from the upstream portion 16*a*2 of the turbine scroll flow passage portion 16*a*2 of the turbine scroll flow passage portion 16*a* to the downstream portion 16*b*1 of the turbine scroll flow passage portion 16*b* is suppressed.

As described above, the distal end portion 120*a* protruding into the turbine scroll flow passage 16 has the surface on the leading side in the rotation direction and the surface on the trailing side in the rotation direction. Moreover, the tapered surface may be formed on only any one of the surface on the leading side in the rotation direction and the surface on the trailing side in the rotation direction of the distal end portion 120*a*. The tapered surfaces may be formed on both of the surface on the leading side in the rotation direction and the surface on the trailing side in the rotation direction of the distal end portion 120*a*.

Moreover, in the above-mentioned embodiment, description has been given of the case in which both the tapered surfaces 20*b* and 20*c* are formed in the distal end portion 20*a* of the tongue portion 20. In this case, compared with the modification example, a thickness (width) of the distal end portion 20*a* of the tongue portion 20 in the rotation direction can be reduced. As a result, a pressure fluctuation is suppressed when the blade 9*b* passes through the position opposed to the distal end portion 20*a* of the tongue portion 20. Consequently, a stress acting on the blade 9*b* is suppressed.

Moreover, description has been given of the tongue portions 20 and 120 in the above-mentioned embodiment and modification example, but the tongue portion 21 also has the same configuration as those of the tongue portions 20 and 120. However, only any one of the tongue portions 20 and 120 and the tongue portion 21 may have the configurations of the above-mentioned embodiment and modification example.

One embodiment of the present disclosure has been described above with reference to the attached drawings, but, needless to say, the present disclosure is not limited to the embodiment described above. It is apparent that those skilled in the art may arrive at various alternations and modifications within the scope of claims, and those examples are construed as naturally falling within the technical scope of the present disclosure.

For example, in the above-mentioned embodiment and modification example, description has been given of the case in which the turbine T is built into the turbocharger C. However, the turbine T may be built into a device other than the turbocharger C, or may be used as a single unit.

Moreover, in the above-mentioned embodiment and modification example, description has been given of the case in which the turbine scroll flow passage 16 includes the two turbine scroll flow passage portions 16*a* and 16*b*. Further, description has been given of the case in which the number of the tongue portions 20, 21, and 120 is two, which is the same as the number of the turbine scroll flow passage portions 16*a* and 16*b*. However, the number of the turbine scroll flow passage portions 16*a* and 16*b* and the tongue portions 20, 21, and 120 may be three or more. Moreover, the turbine scroll flow passage 16 may be a single scroll flow passage (is not required to include the plurality of turbine scroll flow passage portions 16*a* and 16*h*). However, the case in which the turbine scroll flow passage 16 includes the plurality of turbine scroll flow passage portions 16*a* and 16*b* has the following effect. That is, a difference in pressure is large between the turbine scroll flow passage portions 16*a* and 16*b* partitioned by the tongue portions 20, 21, and 120. Therefore, the suppression effect of the leakage amount of the exhaust gas is higher.

INDUSTRIAL APPLICABILITY

The present disclosure is applicable to a turbine and to a turbocharger.

What is claimed is:

1. A turbine, comprising:

a housing having a discharge port;

a turbine rotor, which is arranged in the housing, and includes:

a hub provided on a shaft;

blades provided on an outer periphery of the hub; and an inclined portion, which is formed at an outer peripheral end of each of the blades, and is inclined toward a leading side in a rotation direction as approaching the discharge port side;

a turbine scroll flow passage formed in the housing; and a tongue portion including:

a distal end portion protruding into the turbine scroll flow passage; and a tapered surface, which is formed in the distal end portion, and is inclined toward the leading side in the rotation direction of the shaft as approaching the discharge port side.

2. The turbine according to claim 1, wherein the tapered surface is formed in a surface of the distal end portion on the leading side in the rotation direction.

3. The turbine according to claim 1, wherein the tapered surface is formed in a surface of the distal end portion on a trailing side in the rotation direction.

4. The turbine according to claim 2, wherein the tapered surface is formed in a surface of the distal end portion on a trailing side in the rotation direction.

5. The turbine according to claim 1, wherein the turbine scroll flow passage includes a plurality of turbine scroll flow passage portions, and wherein the number of tongue portions is the same as the number of turbine scroll flow passage portions.

6. The turbine according to claim 2, wherein the turbine scroll flow passage includes a plurality of turbine scroll flow passage portions, and wherein the number of tongue portions is the same as the number of turbine scroll flow passage portions.

7. The turbine according to claim 3, wherein the turbine scroll flow passage includes a plurality of turbine scroll flow passage portions, and wherein the number of tongue portions is the same as the number of turbine scroll flow passage portions.

8. The turbine according to claim 4, wherein the turbine scroll flow passage includes a plurality of turbine scroll flow passage portions, and wherein the number of tongue portions is the same as the number of turbine scroll flow passage portions.

9. A turbocharger, comprising the turbine of claim 1.

* * * * *